US008091259B2

(12) United States Patent
Heather et al.

(10) Patent No.: US 8,091,259 B2
(45) Date of Patent: Jan. 10, 2012

(54) TOWER LIGHT DISPLAY FOR GAMING MACHINE

(75) Inventors: Mark Heather, Indoopoopilly (AU); Stuart Wills, Indoopooilly (AU); Damiano Visocnik, Indoopoopilly (AU)

(73) Assignee: Novomatic AG, Gumpoldskirchen (AT)

( * ) Notice: Subject to any disclaimer, the term of this patent is extended or adjusted under 35 U.S.C. 154(b) by 7 days.

(21) Appl. No.: 11/920,367

(22) PCT Filed: May 15, 2006

(86) PCT No.: PCT/EP2006/004567

§ 371 (c)(1),
(2), (4) Date: Mar. 5, 2009

(87) PCT Pub. No.: WO2006/122738

PCT Pub. Date: Nov. 23, 2006

(65) Prior Publication Data

US 2009/0172980 A1 Jul. 9, 2009

(30) Foreign Application Priority Data

May 16, 2005 (AU) ..... 2005100402

(51) Int. Cl.
*G09F 9/00* (2006.01)

(52) U.S. Cl. ..... 40/564; 40/546; 40/573; 362/312

(58) Field of Classification Search ..... 40/553, 40/581, 546, 558, 564, 568, 569, 570, 573, 40/576, 577; 362/612, 613, 253, 234
See application file for complete search history.

(56) References Cited

U.S. PATENT DOCUMENTS

| | | | | | |
|---|---|---|---|---|---|
| 2,297,851 | A | * | 10/1942 | Wyss, Jr. | 362/223 |
| 2,623,313 | A | * | 12/1952 | Fuchs | 40/546 |
| 3,868,671 | A | * | 2/1975 | Maguire et al. | 340/323 R |
| 4,074,452 | A | * | 2/1978 | Bellinder | 40/571 |
| 5,475,087 | A | * | 12/1995 | Seelig et al. | 530/326 |
| 6,629,019 | B2 | * | 9/2003 | Legge et al. | 700/237 |
| 2005/0090311 | A1 | | 4/2005 | Allitt et al. | |

FOREIGN PATENT DOCUMENTS

| | | |
|---|---|---|
| DE | 202 080820 | 7/2002 |
| DE | 20 2005 005862 | 6/2005 |

* cited by examiner

*Primary Examiner* — Joanne Silbermann
*Assistant Examiner* — Shin Kim
(74) *Attorney, Agent, or Firm* — Dilworth & Barrese, LLP.

(57) ABSTRACT

An innovative approach to displaying gaming machine events and advertising for a gaming console is provided by replacing the commonly-used tower light with an integrated set of game and machine event indicators. The tower light may be used to display the actual game being played or, for example, the price of the game, and can be made of transparent material with separate indicator sections conveying game machine events and related information. The tower light is preferably controlled by a controller unit, with LED lights to light up the indicators.

30 Claims, 2 Drawing Sheets

TOWER LIGHT DISPLAY FOR GAMING MACHINE

FIELD OF THE INVENTION

The present invention relates generally to gaming consoles, gaming machines or networked gaming machines and, more particularly, to tower lights used for gaming machines found in casinos or betting environments.

BACKGROUND OF THE INVENTION

Gaming machines otherwise known as gaming consoles, slot machines, poker machines, pokies or EQMs, have proven very popular and for many years have become one of the base elements of the gaming industry. Over the years, there have been many adaptations used in gaming machines to both advertise and promote certain gaming machines to encourage players to invest money in the chance to win substantial prizes. In particular, gaming machines new to a casino, are often advertised as 'new machines' but the advertising space to do so is quite restrictive. It is common place to see a sticker or cardboard marker indicating a new machine. In either instances, the marker or sticker are generally obtrusive to actual game play, or not distinguishing enough to grab a players attention.

One such place that may be utilised for such advertising is the top of a gaming machine, however a problem presents itself in the top of the gaming machine already being occupied by a tower light used to indicate gaming machine events. A tower light, also known as a gaming machine Candle, has a general function of alerting staff of a gaming machine malfunction or warning status such as the main door of a gaming machine having been opened. Further use may be to indicate to staff a gaming console having been halted due to an abnormally large payout, coinage problem, or other such instances where an attendant may need to attend a gaming console at the gaming consoles request. A further use for the tower light can be found in the service button, where a player activates a service button to manually tell a gaming console to signal an attendant for them.

Where the tower light itself extends from the top of a gaming machine, this prevents the top of a gaming console being used for any valuable advertising space which may be used to advertise the gaming machine itself. In the past this problem has been alleviated by making signage commonly called a Topper, to be placed on top of the gaming machine behind, underneath, above or around the tower light adding expense to the signage due to any lack of standardisation.

It is therefore the intention of this invention to alleviate or at the least provide a valid alternative to the problems in the described prior art. The instant invention will now be described herein in the following embodiments and is not intended to be limited by the scope of the embodiments provided, as other objects, features and advantages of the invention will be apparent from the following detailed disclosure.

SUMMARY OF THE INVENTION

The first broad form of the disclosed invention provides a tower light for a gaming console including at least 2 indicators made from one or more pieces of at least partially transparent material with said indicators being at least partially segregate by one or more cavities penetrating at least partially though said non-opaque material to at least partially separate each said indicator from neighbouring indicators, wherein at least one indicator is a game indicator with an illumination means being at least partially controlled by a controller means and at least one indicator is a machine event indicator with an illumination means being at least partially controlled by said gaming console.

In a preferred embodiment, the tower light indicators are constructed from a single piece of at least partial transparent material such as acrylic, poly carbonate, or plastic material for conducting light. The purer the transparency, the better the material will be at conducting and illuminating light onto etchings, markings, or resin within the transparent material. The tower light indicators to signal machine events preferably also include etching, embossing, or engraving on the transparent material to add to the over all affect. It should therefore be understood that any reference to an indicator where the indicator is made of a material used to conduct light, that etchings, embossing or engravings would preferably also appear on them.

In a further embodiment, the light source for illuminating the machine event indicators and game indicators is illuminated by the use of one or more LED light sources located in a base mount which the tower light indicators are affixed to; though it should be appreciated any such light source may be used. As light shines though the transparent material, any etching made in the transparent material will be lit up as light spills into the actual indicators. Etchings or engravings in this regard aid in focusing any illumination into specific patterns, such as letters or symbols. The etchings or engravings may also be filled with a resign creating a glow to aid in the cosmetic distribution of light when forming images on the indicators.

In one embodiment each indicator may be further separated by one or more pieces of non-transparent material inserted into one or more cavities used to separate the indicators. The cavities may penetrate completely though the light conductive material, however the cavities may only need to penetrate partially though the light conductive material where the spillage is not overly crucial and where it would be more convenient to fill the cavity with a flowable material that may harden overtime, such as an opaque resin. By segregating the indicators in the tower light with at least partially opaque material, such as inserted strips of metal, plastic or other preferably non-light conductive material, light can be relatively contained to not overly spill from one indicator to another. The light source can thusly be shone directly and with more huminance into one indicator without adversely affecting neighbouring indicators allowing a player, attendant or any other person to instantly identify which indicator is being illuminated.

In yet a further embodiment, the transparent material making up the indicators in the tower light may be made of multiple pieces of transparent material having been affixed together by an adhesive material, or being bonded together by a tight frame. Any non-transparent material may then be used to separate the indicators by simply placing the non-transparent material between the indicators before they are bonded together, or by leaving sufficient cavities empty between the indicators as required to prevent light spillage.

To further assist in keeping light within the tower light indicators thereby increasing brightness of the indicators when lit, a layer of non-transparent material may be applied to the external borders of the transparent material leaving only the area where the light initially enters the tower light exposed to the tower lights illumination means.

Typically, a machine event uses an indicator to signal a service attendant to attend the gaming machine whereas a game indicator is used to convey a message to the players themselves. For example a lit indicator of the tower light is used to signal the service attendant while a separate indicator of the tower light in the form of a logo may continue to advertise the game on the gaming console to the player. As such, a machine event may best be understood as a request made by the gaming console for an attendant to service it, where as a game indicator is used to inform players of something relating to the game or a feature of the gaming console itself. For example, the gaming console may use a game machine event to draw attention to itself when its main door has been opened. On the other hand, a game indicator may be used to advertise the game name, or inform the player the game on the gaming console is a new product. Should the game indicator also incorporate a display unit, such as an LCD display, plasma display or other such display means, live jack pot feeds for example may also be displayed. As such, the tower light itself need not be made entirely of a transparent material, but incorporate a video display, carrying the name of the game, various promotions related to a game, recent jackpot wins for a gaming console, or other such game indications. Alternatively, the game indicator may be a static display showing the price required to play the gaming console. It should also be noted that a single display may be used to show both game machine events and game indicators either as separate indicators, or by sharing use of the display at given intervals.

It should also be appreciated that the tower light of this invention may be used interchangeably with other gaming consoles with a common base means which is used by all like tower light. As long as the tower light indicators are located in the same positions, the same base means may be used. As a gaming console no-longer is considered new and the current game interaction has "new game" on it, the indicators of the tower light may be removed and replaced with more appropriate tower light indicators. For example, in an acrylic version with transparent panels making up the indicators, the acrylic portion is simply substituted for a more up to date unit. This allows the tower light and base means to be reused with different gaming consoles as is required. In one embodiment, the base unit of the tower light is arranged with LED's or other illumination means in an inner compartment. The LED's are arranged to match up with corresponding indicators, allowing the indicators to be illuminated by simply turning on its corresponding LEDs.

Where a controller means is employed to control illumination of the indicators via an illumination means, the controller means may be a part of the game console or be located on an independent unit included in the base means or hidden within the game console. In a preferred embodiment, a simple controller means may consist of a small general purpose CPU with embedded flash memory, ram, oscillator, input output controllers and timer interrupts. A further driver component may also be used to implement any CPU instructions to the illumination device which may be used.

The light source used to illuminate the indicators in the tower light device may comprise of LED's, light bulbs, neon-lights, cold cathode tubes, florescent lights or any other form of illumination, means commonly used in the art. In turn, it should be appreciated that light spillage into an indicator provides sufficient control over an indicator to affect the indicators usage.

BRIEF DESCRIPTION OF THE DRAWINGS

The present invention will now be described with reference to the following drawings and examples in order to illustrate the disclosure of this invention. The drawings and examples are provided for illustrative purposes and are not intended to limit the scope of the invention described herein.

The invention will be further described by way of example with reference to the accompanying drawings, in which.

DESCRIPTION OF THE PREFERRED EMBODIMENTS

Figure 1:
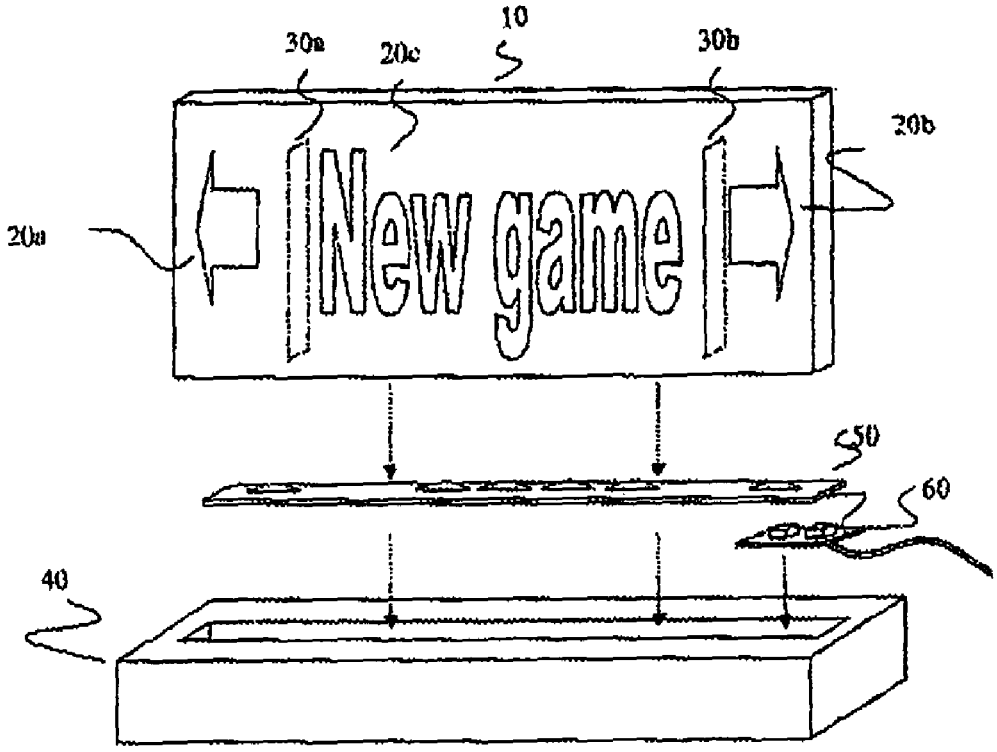
FIG. 1 is a perspective view of a tower light, illumination means, controller means, and base means according to one embodiment of the present invention.
Figure 2:
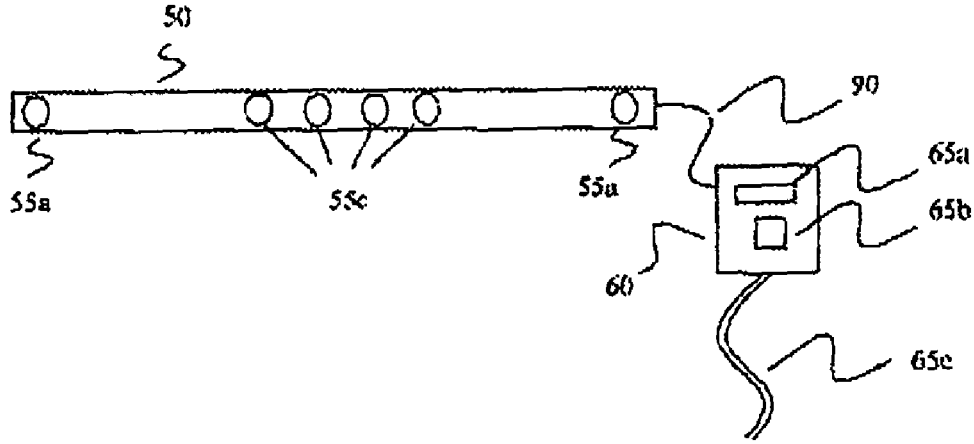
FIG. 2 is a top down schematic view of an illumination means and control means according to one embodiment of the present invention.

FIG. 1 shows an upper tower light portion (10). The upper tower light portion (10) is constructed from an at least partially transparent material with a game indicator (20*c*) having a marking that reads "New Game" and two Machine event indicators (20*a* & 20*b*) with markings of arrows pointing in opposite directions. In the example provided, two strips of non-transparent material (30*a* and 30*b*) are inserted into cavities in the transparent material of the upper tower light portion (10), thereby adding in the partially separating the indicators (20*a* to 20*c*) from each indicators illumination means (50). An illumination means (50) with LEDs (55*a* to 55*c* as illustrated in FIG. 2) is located in a base means or holder means (40) on to which the upper tower light portion (10) is affixed so that when illuminated, the LED's (55*a* to 55*c*) illuminate a specific indicator (20*a* to 20*c*) as required. Preferably non-transparent material is placed within cavities (30*a* to 30*b*) between indicators (20*a* to 20*c*) being preferably reflective in nature to aid in preventing an excess of light spillage inadvertently illuminating an indicator that is not meant to be illuminated. For example should the left cavities (30*a*) with non-transparent material inserted not be present and the game indicator (20*c*) of FIG. 1 is illuminated, the left hand side machine event indicator (20*a*) may also inadvertently be illuminated. Though some spillage may occur where the left hand side cavities (30*a*) non-transparent material is used, the amount of spillage will be minimalised so as to not affect the overall intention of the indicators (20*a* to 20*c*).

The actual upper tower light portion (10) in a preferred embodiment as shown in FIG. 1 in one embodiment is comprised of a single piece of transparent material such as acrylic, poly carbonate, glass, or other transparent material commonly used in the art, however multiple pieces of transparent material may be used by sandwiching the material together to resemble a single piece. It should be appreciated that any other material suited for conducting light whilst maintaining a solid form and being able resist the maximum heat generated by the chosen illumination source will also suffice for the disclosed invention.

Each of the indicators (20*a* to 20*c*) are preferably etched or engraved, so light when shone through the upper tower light portion (10) into an indicator (20*a* to 20*c*), the light source will illuminate the etching creating a clear image of the etching in the colour of whatever light colour may be applied. Like wise, where resin has been used, the resin will glow in the colour the resin has been blended with.

The upper tower light portion (10) light source in a preferred embodiment is provided by a set of LEDs (55*a* to 55*c* as shown in FIG. 2) controlled by a controller means (60). In one embodiment, the controller means (60) is provided on a separate PSB, however the controller means (60) may be integrated into a gaming console, or alternatively be combined with the actual illumination source means (50). The controller means (60) may be programmed to transmit signals to the LED lights (55*a* to 55*c*) turning the LED's on, off, or placing them in a dimmed state as required. In one embodiment, when a machine event needs to be displayed, the controller means (60) is sent a signal from a gaming console which in turn sends a signal to the LED's (55*a* and 55*b*) to illuminate either one or both of the shown machine event indicators (20*a* and 20*b*). At the same time, the game indicator (20*c*) which may currently be illuminated may be dimmed or turned off by the controller means (60) by instructing the middle LED's (55*c*) to no longer illuminate or illuminate at a less intensity. In this way, the gaming console maintains at least partially maintains control over any game event indicators (20*a* and 20*b*)

In an alternate embodiment, the illumination means (50) may be inserted into a concaved portion of the upper tower light portion (10) along with a controller means (60) if need be forgoing the need for a base means (40) to hold the illumination means or the controller means.

FIG. 2 provides a top down schematic view of the illumination means (50) and controller means (60) used to illuminate specific indicators (20*a* to 20*c*) within the upper tower light portion (10). In one embodiment, the controller means (60) is made primarily of a CPU (65*a*) and accompanying driver chip (65*b*) to supplement the CPU (65*a*) in issuing instructions to the LED lights (55*a* to 55*c*) however, the need for a driver chip (65*b*) may depend on the actual CPU (65*a*). A communications connector (65*c*) is also provided to receive signals from a gaming console with regards to machine events and any other game console instructions. The communications connector (65*c*) may also be used to provide power to the controller means (60) and in turn to the illumination means (60) via the illumination means communications connector (90), however an external power supply may also be used to supply power to either the Summations means (50) or the controller means (60). The CPU (65*a*) need only operate at a basic level, with minimal storage capacity to coordinate the use of LED's (55*a* to 55*c*) of the illumination means (50) via an illumination means communications connector (90). The sophistication of the actual coordination and amount of instructions including sequence length of LED (55*a* to 55*c*) timing changes may be increased proportional to the capacity of the controller means (60) CPU (65*a*) and accompanying components. In one embodiment, the middle LEDs (55*c*) are kept in a constant 'on' mode to continuously illuminate the game indicator (20*c*). In yet another embodiment, in accordance with the program on the CPU (65*a*) or external memory source (not shown), the game indicator (20*c*) may flash on and off, change colours, or oscillate in a random or scripted manor the LED's (55*a* to 55*c*) in use. As such, the type of LED's used may vary to allow true colour or a single monotone colour output.

It should be noted that in one embodiment, control of the indicators (20*a* to 20*c*) in the upper tower light portion (10) may be directly made though software in a gaming console thereby forgoing the need for an independent controller means (60).

Figure 3:
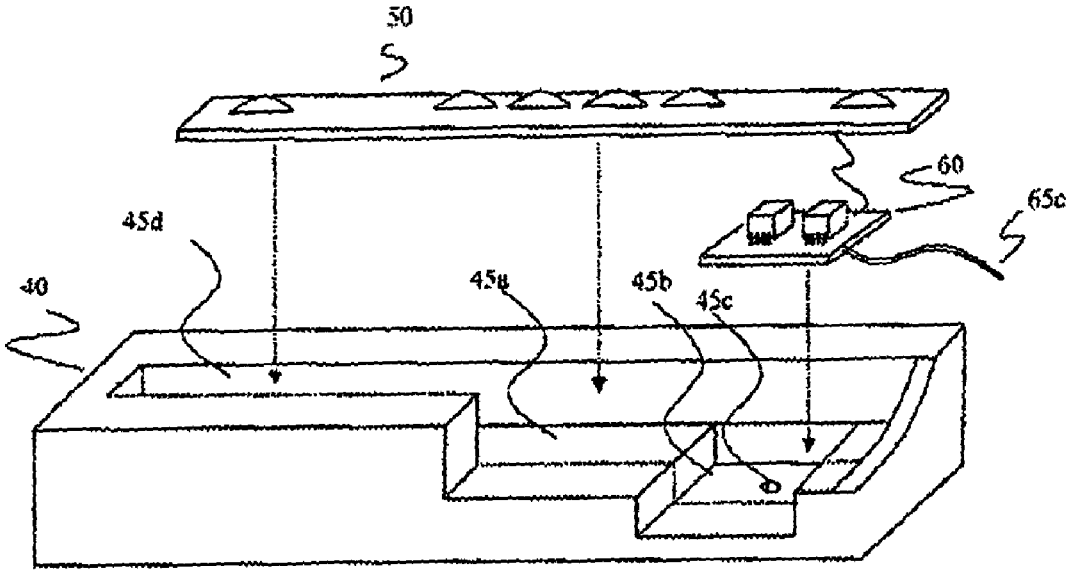
FIG. 3 is a sectional view of an illumination means, controller means, and base means according to one embodiment of the present invention.

FIG. 3 provides a cut away section of the base means (40) where the front right hand side has been removed to reveal in one embodiment two inner compartments (45*a* and 45*b*). The controller means (60) may be inserted into the lower compartment (45*b*) with the illumination means (50) resting directly on top of the controller means (60); A small outlet (45*c*) is provided for the communications connector (65*c*). The actual placing of the internal compartments is not critical to the invention and merely provides one alternative. The upper tower light portion (10) may then be freely inserted into the open slot (45*d*) in the base means (40) being held by gravity, or some other means such as a fastening device if need be. This allows for convenient replacing of the upper tower light portion (10) at almost any time. A further set of clips or miniature shelves (not shown) may be used to keep the upper tower light portion (10) from making contact with the illumination means (50) or alternatively used to fasten the upper tower light portion (10) in position. The one or more clips, or miniature shelves may be fastened to the inner wall of the open slot (45*d*) just above the illumination means (50) to prevent any direct contact.

Figure 4:
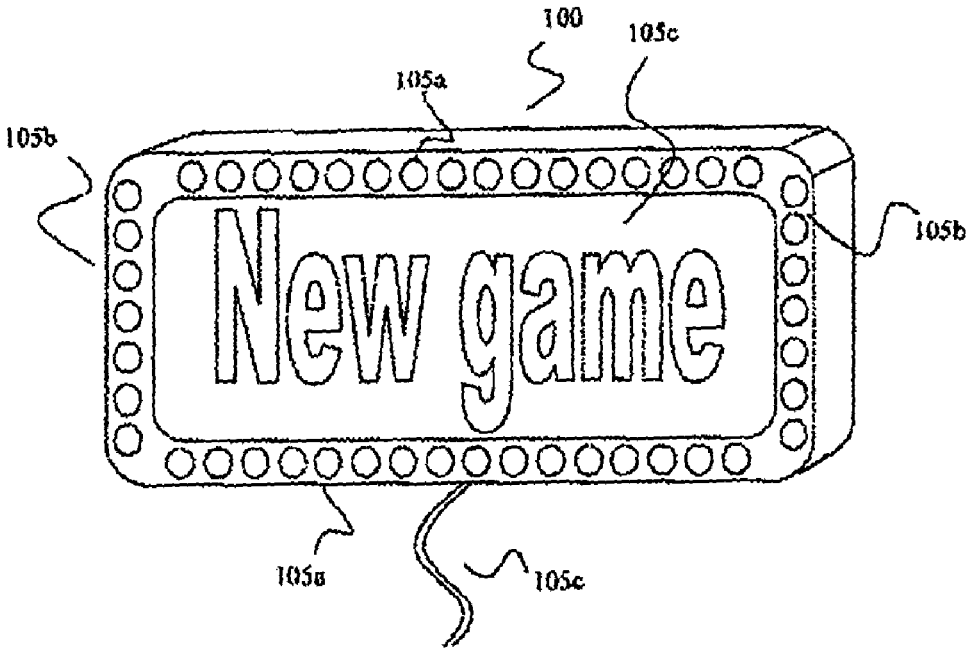
FIG. 4 is a schematic diagram of a tower light in accordance with an alternate embodiment of the present invention.

FIG. 4 provides an alternate embodiment of the disclosed invention. The example tower light (100) of FIG. 4, provides direct illumination by LED's for the machine event indicators (105*a* and 105*b*) when a machine event occurs. The game indicator (105*c*) in the example is lit by illumination deceives from behind the actual viewing area. In such a case, the message to be conveyed need not be etched into the game indicator (105*c*), but may be affixed, embossed or painted over the game indicator (105*c*) itself. Alternatively, the game indicator (105*c*) may also be a visual display means such as a television, monitor, LCD or other display unit typically used for live advertising. A controller means (60) may be imbedded in the tower light, or placed in an appropriate base means.

The machine event indicators (105*a* and 105*b*) in the provided example may be used concurrently with the game indicator (105*c*) acting as game indicators to further emphasise a game message, preferably flashing in either a different colour or varied manner. In the case machine event indicators (105*a* and 105*b*) need to be used as machine event indicators, the game indicator (105*c*) would preferably be switched off allowing focus to be aimed at the machine event indicators (105*a* and 105*b*) to alert attendants to the gaming console.

While we have shown and described certain embodiments of the present invention, it should be understood that this invention is subject to many modifications and changes without departing from the spirit and scope of the appended claims.

We claim:

1. A tower light for a gaming console, the tower light including a base mount and illumination means, the illumination means being arranged within said base mount to be aligned with at least two indicators of a mountable upper tower light portion so that a specific indicator of said upper tower light portion is illuminated when the illumination means of the base mount is operative, a mountable upper tower light portion situated above said base mount, constructed of at least partially transparent material, said mountable upper tower light portion comprising:

at least two indicators made from one or more pieces of at least partially transparent material with said indicators being at least partially segregated by one or more enclosed cavity housing being formed within said partially transparent material of said mountable upper tower light portion and penetrating at least partially through said partially transparent material to at least partially separate each said indicator from adjacent indicators and having an opening coincident with at least one face of tower light, one or more pieces of at least partially opaque material insertable into said opening of said one or more enclosed cavity housings forming a pocket within said cavity housings, said one or more pieces for separating said at least two indicators and preventing light spillage between said at least two indicators, wherein the insertion or removal of said one or more pieces of at least partially opaque material do not change the physical dimension of the tower light, wherein said at least two indicators and said one or more pieces of at least partially opaque material form a replaceable single unit with the one or more pieces of at least partially opaque material being inserted in said one or more enclosed cavity housings, wherein said replaceable single unit is interchangeably mounted to said base unit indicators with said one or more pieces of at least partially opaque material being inserted in said one or more enclosed cavity housings are interchangeably mountable as a unit to said base mount wherein at least one indicator of the at least two indicators is a game indicator with illumination means associated therewith at least partially controlled by controller means, and wherein at least one other indicator of the at least two indicators is a machine event indicator, with illumination means associated therewith, at least partially controlled by said gaming console.

2. The tower light of claim 1 wherein said at least partially transparent material is acrylic, poly carbonate, or plastic.

3. The tower light of claim 2 wherein at least one indicator includes etchings or engravings.

4. The tower light of claim 3 wherein said one or more cavities separating said indicators is at least partially filled with an at least partially opaque material.

5. The tower light of claim 4 wherein said tower light indicators are affixed to base means housing said illumination and controller means.

6. The tower light of claim 3 wherein said tower light indicators are affixed to base means housing said illumination and controller means.

7. The tower light of claim 2 wherein said one or more cavities separating said indicators is at least partially filled with an at least partially opaque material.

8. The tower light of claim 7 wherein said tower light indicators are affixed to base means housing said illumination and controller means.

9. The tower light of claim 2 wherein said tower light indicators are affixed to base means housing said illumination and controller means.

10. The tower light of claim 1 wherein at least one indicator includes etchings or engravings.

11. The tower light of claim 10 wherein said one or more cavities separating said indicators is at least partially filled with an at least partially opaque material.

12. The tower light of claim 11 wherein said tower light indicators are affixed to base means housing said illumination and controller means.

13. The tower light of claim 10 wherein said tower light indicators are affixed to base means housing said illumination and controller means.

14. The tower light of claim 1 wherein said one or more cavities separating said indicators is at least partially filled with an at least partially opaque material.

15. The tower light of claim 14 wherein said tower light indicators are affixed to base means housing said illumination and controller means.

16. The tower light of claim 1 wherein said tower light indicators are affixed to a base means housing said illumination and controller means.

17. The tower light of claim 16 wherein said tower light indicators are affixed to base means housing said illumination and controller means.

18. The tower light of claim 1 wherein said at least two indicators include a plurality of cavities wherein each of said cavities is filled with a piece of at least partially opaque material.

19. The tower light of claim 1 wherein the base mount together with the illumination means forms a base unit wherein said at least two indicators with said one or more pieces of at least partially opaque material being inserted in the one or more cavities of said indicators is mountable and demountable as a unit to and from said base unit with the illumination means being held at said base mount.

20. The tower light of claim 1 wherein the base mount includes two inner compartments, which together with the illumination means forms a base unit wherein said at least two indicators with said one or more pieces of at least partially opaque material being inserted in the one or more cavities of said indicators is mountable and demountable as a unit to and from said base unit with the illumination means being held at said base mount.

21. The tower light of claim 1, wherein the base mount comprises two inner compartments, a first compartment for holding a controller means and a second compartment for holding illumination means, an open slot on a top side of the base mount for inserting a mountable upper tower light portion, an inner wall of the open slot including one or more separation devices for preventing direct contact between the illumination means and the mountable upper tower light portion, the illumination means being arranged within said base mount to be aligned with at least two indicators of a mountable upper tower light portion so that a specific indicator of said upper tower light portion is illuminated when the illumination means of the base mount is operative.

22. The tower light of claim 1 wherein the game indicator is constructed from an at least partially transparent material.

23. The tower light of claim 1 wherein the game indicator is configured to display messages to players.

24. The tower light of claim 1 wherein the at least one machine event indicator operatively signals a service attendant via illumination means to attend the gaming console in response to receiving control signals from said gaming console.

25. The tower light of claim 1 wherein the at least one machine event is partially segregated by the game indicator and one or more internal housing cavities inserted into the game indicator.

26. The tower light of claim 1 wherein each internal housing cavity has inserted into said housing cavity, one or more pieces of at least partially opaque reflective material thereby aiding in preventing light spillage between said at least two indicators.

27. The tower light of claim 1 wherein the game indicators are switched off whenever the at least two machine event indicators are operative.

28. A tower light for a gaming console including at least two indicators made from one or more pieces of at least partially transparent material with said indicators being at least partially segregated prevent light spillage from one indicator to another, said at least two indicators being at least partially segregated by one or more enclosed cavity housings and penetrating at least partially through non-opaque material comprising an upper portion of said tower light to at least partially separate each indicator from an adjacent indicator, said enclosed cavity housing having an opening coincident with at least one face of tower light, one or more pieces of at least partially opaque material insertable into said opening of said one or more enclosed cavity housing forming a pocket within said cavity housing, said one or more pieces of said at least partially opaque material for separating said at least two indicators and preventing light spillage between said at least two indicators, wherein at least one indicator of said at least two indicators is a game indicator with illumination means at least partially controlled by controller means, wherein at least one indicator of said at least two indicators is a machine event indicator with illumination means at least partially controlled by said gaming console, wherein said at least one machine event indicator operatively signals a service attendant to attend the gaming console in response to receiving control signals from said gaming console, wherein said at least one game indicator operatively informs players of game features of the gaming console, wherein when said at least one machine event indicator is illuminated for purposes of servicing the game console, said at least one game indicator is reduced in amplitude when in an on state wherein the insertion or removal of said one or more pieces of at least partially transparent material do not change the physical dimension of the tower light.

29. A gaming console including a tower light extending from one of a top or side surface of said gaming console, said tower light including at least two indicators made from one or more pieces of at least partially transparent material with said at least two indicators being at least partially segregated by one or more enclosed cavity housings being formed within an upper portion of said tower light and penetrating at least partially through said at least partially transparent material to at least partially separate each said at least two indicators to prevent light spillage there-between, said enclosed cavity housings having an opening coincident with at least one face of said tower light, one o" more pieces of at least partially opaque material insertable into said opening of said one or more enclosed cavity housing forming a pocket within said cavity housings, said one or more pieces for separating said at least two indicators and preventing light spillage between said at least two indicators, wherein at least one indicator of said at least two indicators is a game indicator with associated illumination means at least partially controlled by controller means, wherein at least one indicator of said at least two indicators is a machine event indicator with associated illumination means at least partially controlled by said gaming console, wherein said at least one machine event indicator issues operative signals in response to receiving control signals from said gaming console with regard to machine events, wherein said at least one game indicator operatively informs players of at least one game feature of the gaming console unrelated to machine events wherein the insertion or removal of said one or more pieces of at least partially transparent material do not change the physical dimension of the tower light.

30. A tower light for a gaming console, the tower light comprising:

a base mount and illumination means, the illumination means being arranged with the base mount; and an upper tower light portion comprising at least two indicators made from one or more pieces of at least partially transparent material with said indicators being at least partially segregated by one or more enclosed cavity housings being formed within an upper portion of said tower light and penetrating at least partially through said at least partially transparent material to cavities in the transparent material of the upper tower light portion, there-between, said enclosed cavity housings having an opening coincident with at least one face of said tower light, one or more pieces of at least partially opaque material being inserted into said opening of said one or more enclosed cavity housings thereby adding in the partially separating said at least two indicators and preventing light spillage between said at least two indicators, said one or more pieces of at least partially opaque material forming part of the upper tower light portion and being held by the transparent material of said upper tower light portion, the upper tower light portion being affixed with the base mount such that each of said two indicators of the upper tower light portion is aligned with at least one illumination means so that only a specific indicator of said upper tower light portion is illuminated when the respective one of the illumination means of the base mount is operative, wherein at least one indicator of the at least two indicators is a game indicator with the illumination means associated therewith at least partially controlled by controller means, and wherein at least one other indicator of the at least two indicators is a machine event indicator, with illumination means associated therewith at least partially controlled by said gaming console.

* * * * *